US008555586B2

(12) United States Patent
Lowe et al.

(10) Patent No.: US 8,555,586 B2
(45) Date of Patent: Oct. 15, 2013

(54) STRUCTURAL MODULES WITH ABSORBENT ELEMENTS FOR DRAINAGE AND IRRIGATION

(76) Inventors: Timothy Robert Lowe, Hinckley (GB); Andrew Shuttleworth, Poulten-le-Fylde (GB); Paul David Culleton, Warrington (GB); Tim Puehmeier, Loehne (DE)

( * ) Notice: Subject to any disclaimer, the term of this patent is extended or adjusted under 35 U.S.C. 154(b) by 311 days.

(21) Appl. No.: 12/676,122

(22) PCT Filed: Sep. 3, 2008

(86) PCT No.: PCT/GB2008/002977

§ 371 (c)(1),
(2), (4) Date: Aug. 2, 2010

(87) PCT Pub. No.: WO2009/030896

PCT Pub. Date: Mar. 12, 2009

(65) Prior Publication Data

US 2010/0300019 A1 Dec. 2, 2010

(30) Foreign Application Priority Data

Sep. 3, 2007 (GB) ..... 0717081.4

(51) Int. Cl.

| | |
|---|---|
| ***E04B 1/00*** | (2006.01) |
| ***E04B 1/16*** | (2006.01) |
| ***E04C 1/00*** | (2006.01) |
| ***E02B 15/00*** | (2006.01) |
| ***E02B 11/00*** | (2006.01) |
| ***A01G 9/02*** | (2006.01) |
| ***A01G 25/00*** | (2006.01) |
| ***E01C 3/00*** | (2006.01) |

(52) U.S. Cl.
USPC ..... 52/310; 52/169.5; 52/309.6; 210/170.03; 47/66.5; 47/80; 47/82; 405/45; 404/29

(58) Field of Classification Search
USPC ..... 52/169.5, 309.4, 309.6, 310, 309.8, 52/309.9; 210/170.03; 47/20.1, 21.1, 65.5, 47/66.1, 66.5, 66.6, 79, 80, 82; 405/43, 405/45; 404/27, 28, 29, 34, 40
See application file for complete search history.

(56) References Cited

U.S. PATENT DOCUMENTS 2,138,015 A * 11/1938 Barnhart ..... 52/310
2,199,946 A * 5/1940 Barnhart ..... 52/310

(Continued)

FOREIGN PATENT DOCUMENTS

| | | |
|---|---|---|
| GB | 2399567 | 9/2004 |
| WO | 0214608 | 2/2002 |
| WO | 03035559 | 5/2003 |
| WO | 2006077421 | 7/2006 |

*Primary Examiner* — Ryan Kwiecinski
(74) *Attorney, Agent, or Firm* — McDonnell Boehnen Hulbert & Berghoff LLP

(57) ABSTRACT

A structural module (10) for use in water irrigation, water drainage, water retention and water filtering systems, comprises a load bearing base unit (10) and porous material (15), wherein the base unit has a top wall (11) and a bottom wall (12) spaced therefrom by one or more supporting elements (13, 20) so as to define a volume between the top and bottom walls. The base unit being provided with apertures (17, 18, 19) to permit the flow of liquid into and out of the volume. The porous material is a block (15) foamed polymeric material which occupies a substantial portion of the volume within the base unit and absorbs and retains water that passes through the apertures.

11 Claims, 13 Drawing Sheets

(56) References Cited

U.S. PATENT DOCUMENTS

| | | | | | |
|---|---|---|---|---|---|
| 3,220,194 | A | * | 11/1965 | Leonce | 405/45 |
| 3,593,480 | A | * | 7/1971 | Bouchillon | 52/415 |
| 4,483,640 | A | * | 11/1984 | Berger et al. | 405/15 |
| 5,437,698 | A | * | 8/1995 | Furukawa | 47/65.9 |
| 5,580,770 | A | | 12/1996 | DeFilippi | |
| 5,730,548 | A | * | 3/1998 | Brero et al. | 404/27 |
| 5,810,510 | A | * | 9/1998 | Urriola | 405/45 |
| 5,916,104 | A | * | 6/1999 | Lucenet et al. | 52/791.1 |
| 5,962,309 | A | | 10/1999 | Kumagai et al. | |
| 7,080,480 | B2 | * | 7/2006 | Urban et al. | 47/48.5 |
| 7,166,221 | B1 | | 1/2007 | Young et al. | |
| 7,591,610 | B2 | * | 9/2009 | Krichten et al. | 405/50 |
| 7,704,011 | B2 | * | 4/2010 | Marshall | 404/29 |
| 7,914,228 | B2 | * | 3/2011 | Rapaz | 404/34 |
| 2002/0152676 | A1 | * | 10/2002 | Chan | 47/65.5 |
| 2006/0123704 | A1 | * | 6/2006 | Yoshida et al. | 47/79 |
| 2010/0108617 | A1 | * | 5/2010 | Schmidt et al. | 210/768 |
| 2011/0225883 | A1 | * | 9/2011 | Clifford | 47/82 |
| 2011/0271591 | A1 | * | 11/2011 | Walton et al. | 47/66.7 |

* cited by examiner

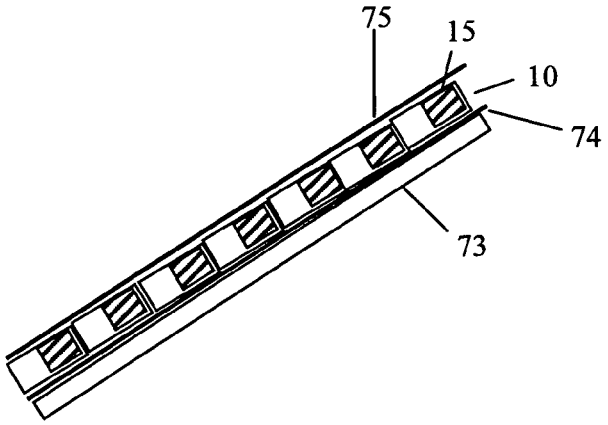
FIG. 18
FIG. 19
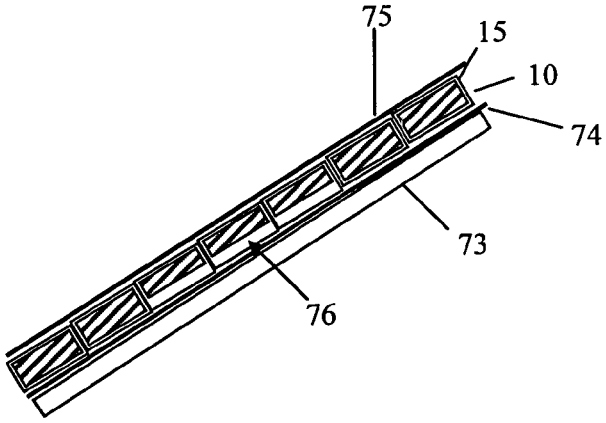
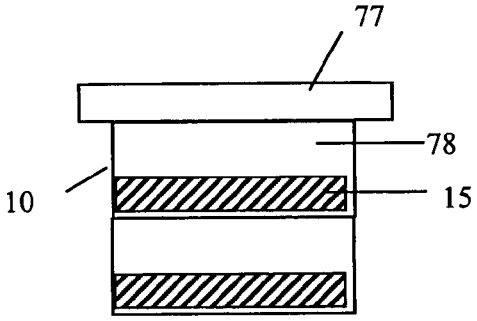
FIG. 20
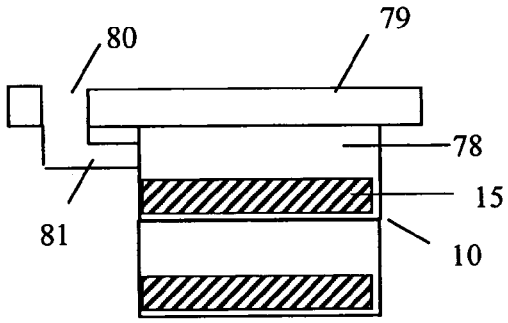
FIG. 21
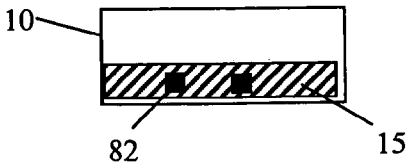
FIG. 22

STRUCTURAL MODULES WITH ABSORBENT ELEMENTS FOR DRAINAGE AND IRRIGATION

This invention relates to structural modules for use, for example in the construction of a sub-base layer for a pavement, roadway, building foundation, soft landscaping and so forth, as well as for the construction of retaining walls, embankments and other civil engineering structures.

In WO 02/14608, there is disclosed a structural module intended primarily for use in the construction of a sub-base layer, in place of traditional particulate materials such as natural aggregate. The preferred module is cuboid in form, and may for example be moulded from strong plastics. In a preferred arrangement each module is formed from a top half which includes a top wall and the upper part of a peripheral sidewall, and a bottom half defining a bottom wall and the lower part of the peripheral sidewall. The top and bottom halves may each be provided with a set of half-pillars extending towards one another, the two sets of half-pillars co-operating with one another to form pillars extending between the top and bottom walls to resist vertical and lateral crushing of the module. The top and bottom halves may be two integral plastics moulded components which are fitted one inverted on top of the other. Preferably, the module further comprises a network of bracing members extending between the pillars within the module to resist deformation of the module in a horizontal plane. In the preferred arrangement the walls and network are apertured to allow fluid flow both vertically and horizontally through the module.

It is stated in WO 02/14608 that in addition to providing structural strength, the sub-base layer can provide a temporary storage tank for holding and dissipating large volumes of water, and also enables water to be redistributed away from localised areas where a lot of water collects. It is suggested that by including infill media in the modules, filtration, chemical and biological treatment may be achieved before it reaches the water table or conveyed to a drainage outfall.

GB 2399567 discloses a development of this system, in which a buoyant surface element is provided within the module and is movable to float on water within the module. The buoyant element is for receiving contaminants floating on the surface of the water. It may provide a surface on which a biofilm may form. Typically, the buoyant element is a fibrous mat. If the mat does not have sufficient buoyancy, it may be provided with floats, for example hollow plastic floats or polystyrene floats.

Another approach to providing a sub-base layer is disclosed in WO 2006/077421. In this arrangement, a sub-base layer of load bearing particulate material has porous foamed polymeric material distributed in the interstitial spaces. Preferably the polymeric material is an open celled phenolic foam such as foamed phenol formaldehyde resin. The porous foamed material absorbs water and also serves to retain micro-organisms to break down pollutants.

It has now been appreciated that absorbent materials such as those disclosed in WO 2006/077421 can be used to advantage in sub-base layers in significant volumes to absorb water, and that this can be achieved by filling a substantial portion of the volume within a rigid structural module with such absorbent material.

Viewed from one aspect there is provided a structural module having a top wall and a bottom wall spaced therefrom by one or more supporting elements so as to define a volume between the top and bottom walls, the module being provided with apertures to permit the flow of liquid into and out of the volume, wherein a substantial portion of the volume is occupied by a porous foamed polymeric material which absorbs and retains substantial quantities of water that passes into the enclosed volume through the apertures.

The module may be provided with a peripheral wall extending between the top and bottom walls, and acting as a supporting element. One or more of the top, bottom and peripheral walls may be provided with the apertures to permit liquid flow to and from the volume. The module may be of generally, cuboid form, and the top and bottom walls may be generally parallel.

Preferably, the porous foamed polymeric material has a cellular structure. It may, for example be an open celled phenolic foam. One suitable type of foam is made from a phenol formaldehyde resin which has been reacted with an acid catalyst to be cured, and to which a hydrocarbons has been added to make the resin expand. This is the type of foam used in preferred embodiments of WO 2006/077421.

The foamed polymeric material could be in particulate form, for example being in the form of spheres or the like. If the apertures in the module are small enough to retain the particulate material, it may be added loose to the interior of the module. If that is not so, and in any event for more secure retention of the material, the particulate foamed polymeric material could be contained within a porous or permeable bag, such as a net, and placed in the module. Preferably, however, the foamed polymeric material is in the form of one or more blocks or slabs. In such an arrangement, a block can have any shape and does not need to be cuboid for example. Large spheres, irregular shapes and so forth may all be used.

Whilst the foamed material may be placed within the module with freedom to move, preferably an element such as a block or slab is fixed spatially within the module by suitable locating means. For example, the module may incorporate internal pillars as disclosed in WO 02/14608 and the block or slab may be apertured so that the pillars can pass through the apertures, the aperture size being such that there will be sufficient friction between the pillar and the block or slab to hold the block or slab in position both horizontally and vertically. This is a different arrangement to the location system disclosed in GB 2399567, where although pillars pass through apertures in the mat, the mat is free to slide up and down the pillars so that it can float on the surface of liquid within the module. The internal pillars serve as supporting elements extending between the top and bottom walls.

There are many possibilities for the proportion of the free interior volume that should be occupied by the foamed polymeric material, depending upon the application in which the module will be used. The occupied portion could be substantially all of the free interior volume, a major part of the interior volume and a minor part of the interior volume. Possibilities range for example from about 20% to substantially all of the free interior volume, and encompass about 25%, about 30%, about 35%, about 40%, about 45%, about 50%, about 55%, about 60%, about 65%, about 70%, about 75%, about 80%, about 85%, about 90%, and about 95%, about 100%, or be within any range whose lower limit is defined by one of those values and whose upper limit is defined by another of those values. The free interior volume means the interior volume within the walls, excluding space taken up by elements such as pillars or other structural members within the interior volume.

Preferably, the portion of the interior volume of the module that is occupied by the foamed polymeric material occupies a single layer extending horizontally. This layer could extend from adjacent the top wall, or from adjacent the bottom wall, or could be arranged intermediate the two, for example about mid-way between the two. In some preferred arrangements, a substantial portion of the interior volume is left vacant, for example around 50%, providing a horizontally extending space across the module. In such an arrangement, if two modules are stacked on top of each other, in the vertical direction there will be alternating horizontally extending layers of free space and porous material. This provides vertically arranged layers where water can flow freely in the lateral direction, alternating with layers where the water is absorbed.

One advantage of a system in which there are alternating layers of free space and porous material, is that for any such porous material there will be a maximum vertical distance to which liquid can be absorbed, depending on the nature of the capillary effect within the porous material. A block of porous material that exceeds this height will not be used to maximum efficiency in absorbing water, because the water will not be retained above the maximum vertical distance. Having a number of block or slabs of lower heights, each of which can absorb to close to its limit, is more efficient.

Thus in general, a block or slab of the porous polymeric material has a height which does not exceed substantially the maximum height to which water can be retained within the slab or block. In the case of the preferred phenol formaldehyde resin, this distance might be about 75 mm or about 150 mm, and in general maximum heights might be about 75 mm, about 100 mm, about 125 mm, about 150 mm, about 175 mm, or about 200 mm, or be within any range whose lower limit is defined by one of those values and whose upper limit is defined by another of those values.

An alternative to having a relatively deep module only partly occupied by foam, would be to have a shallower module fully occupied by foam. Such shallow modules could then be alternated with modules containing no foam, which could also be shallow or of greater height, to provide alternating foam layers and vacant layers.

In general, a module may be have a depth of about 150 mm, about 175 mm, about 200 mm, about 225 mm, about 250 mm, about 275 mm, about 300 mm, about 325 mm, about 350 mm, or be within any range whose lower limit is defined by one of those values and whose upper limit is defined by another of those values. Preferably the length and breadth dimensions of the module are both greater than the depth. A typical module in a preferred embodiment might have a length of between about 700 mm to about 720 mm, for example being about 710 mm; a breadth Of from about 350 mm to about 360 mm, for example being about 355 mm; and a depth in the ranges set out above, for example being about 150 mm, about 250 mm or about 300 mm.

The invention also extends to a structure comprising a plurality of modules as above described, arranged vertically and/or horizontally.

Viewed from another aspect, there is provided a structure comprising a number of structural modules connected to each other vertically and/or horizontally, each module having a top wall and a bottom wall spaced therefrom by one or more supporting elements so as to define a volume between the top and bottom walls, the module being provided with apertures to permit the flow of liquid into and out of the volume, wherein a substantial portion of the volume is occupied by a porous foamed polymeric material which absorbs and retains substantial quantities of water that passes into the enclosed volume through the apertures.

Means may be provided to connect the modules together, for example as described in WO 02/14608.

Viewed from another aspect, there is provided a structure comprising a number of structural modules connected to each other vertically, each module having a top wall and a bottom wall spaced therefrom by one or more supporting elements so as to define a volume between the top and bottom walls, the module being provided with apertures to permit the flow of liquid into and out of the volume; and wherein at least one of the structural modules has within its volume a horizontally extending layer of a porous foamed polymeric material which absorbs and retains substantial quantities of water that passes into the enclosed volume through the apertures, the arrangement being such that the structure has alternating layers of free space and the foamed polymeric material.

There may be two layers in total, or more. There may be a plurality of free space layers, or a plurality of foamed polymeric material layers, or both The liquid retentive polymeric foam material for use in accordance with the various aspects of the invention is porous so that it can absorb water and other liquids, or microorganisms for use in the biological decomposition of spillages such as oil. The material should also be such, that it undergoes little or no expansion when it absorbs water or other liquids. The material should preferably be non-biodegradable, although there may be applications it which it is desired to use a foam that decomposes. The liquid retentive foam material is preferably relatively solid, rather than being easily compressible such as a sponge-like foam. In preferred embodiments, the liquid retentive foam material has a cellular structure with an average pore size (i.e. cross sectional area) in the range of for example about 1200 to about 10000 $\mu m^2$, preferably about 1500 to about 4000 or about 4500 $\mu m^2$, and typically an average pore size of around 4000 to 4225 $\mu m^2$.

Preferably, the liquid retentive material is an open celled phenolic foam, for example made from phenol formaldehyde resin, such as that marketed by Smithers-Oasis under the trade mark OASIS™ which is used principally as floral foam into which flower stems can be pushed. This type of foam has been classified for disposal in landfill sites in the UK. It is inert, does not biodegrade over time, does not expand and has minimal mechanical strength, so that it crumbles under load. The OASIS™ foam is made from phenol formaldehyde resins which are reacted with an acid catalyst to be cured, and hydrocarbons are added to make the resin expand. The final product, typically in the form of a brick, has no hydrocarbons present, and has slight acidity with everything else inert. The potential for water retention and other qualities is a function of the material's pore size. The pore size is related to the density of the foam produced at the manufacturing stage. For example, the current range of OASIS™ products available for general flower arranging purposes includes these three densities:

- Premium Foam: about 21 to about 23 $kg/m^3$ density gives the best water retention due to it greater volume of cells within the structure.
- Ideal Foam: about 19 $kg/m^3$ to about 21 $kg/m^3$ and good water retention.
- Classic Foam: just below 19 $kg/m^3$ and good water retention.

A typical foam material for use in accordance with the invention can preferably hold between about 40 to 50 times its own mass in water, for example one gram of the foam can retain between about 40 and about 50 ml of water and in a preferred embodiment of the invention about fifty times its own mass. These figures are for the material before use in situ. In a preferred embodiment, in situ the material holds between about 20 to 50 times its own mass of water, more preferably between about 40 and 50 times, and typically between about fifteen and about twenty times its own mass of water.

Oil degrading microbial communities are produced by the association between oil, nutrients, water and substrates bearing microbial spores. A system in accordance with the present invention features the ability to store and decontaminate water. The preferred average pore size will permit micro organisms to penetrate the interior of the material. This pore size is large enough to allow bacteria, fungi, protozoa and metazoa to enter.

In practice, with a given average pore size there may be considerable variation in the pore sizes. It is possible that this difference in sizes would allow certain microbes to penetrate more easily than others. Restriction of some organisms from the interior of the foam may produce a variety of microbial communities thus allowing a refuge from predator organisms and maintenance of an oil degrading community. The highly porous structure will also allow the system to remain aerated and allow evaporation of the stored water, preventing the production of anaerobic conditions and stagnant water.

Alternative foams or indeed other materials may be used to absorb and retain water, such as polyurethane and polyisocyanurate foams, urea-formaldehyde (carbamide-formaldehyde) or epoxy (sprayed or foamed in-situ). Although the polyurethane foams do not have particularly good water retention properties they can be modified so as to increase the water retaining capabilities. Thus, polyurethane derivatives may be suitable for use in systems in accordance with the invention. It may also be possible to improve the water retention properties of polyurethane foams by having a closed cell structure. Indeed, in general foams used in systems according to the invention can be open or closed cellular structured within the foams, but primarily the optimum used would be open celled. Modifications to foams so that they can perform the same or similar functions of the preferred foams, are within the scope of the invention.

There is also on the market a cross-linked polyacrylamide, which is a crystal like structure that absorbs 500 times its own mass in water. It is possible that this could be used in a system in accordance with the invention although it suffers from expansion and bio-degradability problems over time. Also on the market there is another compound that has good water absorbing properties called sodium polyacrylate. It is not foam, and more like a desiccant, but might be usable in aspects of the invention, alone or in combination with a foamed polymeric material.

In the case of foamed polymeric material, it may be preformed in suitable blocks, slabs or the like, or it could be formed in-situ.

As regards the structure of the modules, preferably these are of moulded plastics material. In a preferred arrangement, each module is formed from a top half which includes a top wall and the upper part of a peripheral sidewall, and a bottom half defining a bottom wall and the lower part of the peripheral sidewall. The top and bottom halves may be fitted one inverted on top of the other. A slab, block or the like of the foamed polymeric material can be located within one or both halves before they are fitted together. The top and bottom halves may each be provided with a set of half-pillars extending towards one another, the two sets of half-pillars co-operating with one another to form pillars extending between the top and bottom walls to resist vertical crushing of the module. In this case, the foamed material may have apertures and be placed over a set of pillars before the halves are joined together. The halves may be two similar integral plastics moulded components.

Preferably, the module further comprises a network of bracing members extending between the pillars within the module to resist deformation of the module in a horizontal plane. In the preferred arrangement the walls and network are apertured to allow fluid flow both vertically and horizontally through the module.

It will be appreciated that the presence of a peripheral wall can be used to separate and support the top and bottom walls.

Although in the preferred embodiment the module is of plastics and load bearing, it could be made of any other type of material that could support the loads expected in a particular environment, such as concrete, metal, wood, composite materials and so forth. In some environments the modules need not be load bearing.

The preferred module can be used in a number of environments, and it is not necessary that it contains water retentive foam. In filtering applications as discussed below in some embodiments of the invention, there may be used foams which are porous but not water retentive or at least not as efficiently retentive as the absorbent materials which are discussed. In some applications, impervious foams may be used. Where water retention is desired, materials other than foams may be used.

Viewed from another aspect there is provided a structural module having a top wall and a bottom wall spaced therefrom by one or more supporting elements so as to define a volume between the top and bottom walls, the module being provided with apertures to permit the flow of liquid into and out of the volume, wherein a substantial portion of the volume is occupied by a water retentive material which absorbs and retains substantial quantities of water that passes into the enclosed volume through the apertures.

Viewed from another aspect there is provided a structural module having a top wall and a bottom wall spaced therefrom by one or more supporting elements so as to define a volume between the top and bottom walls, the module being provided with apertures to permit the flow of liquid into and out of the volume, wherein a substantial portion of the volume is occupied by a foamed polymeric material.

Viewed from another aspect there is provided a structural module having a top wall and a bottom wall spaced therefrom by one or more supporting elements so as to define a volume between the top and bottom walls, the module being provided with apertures to permit the flow of liquid into and out of the volume, wherein a substantial portion of the volume is occupied by a filtering material.

There are many possibilities for the proportion of the free interior volume that should be occupied by the water retentive material, or the foamed polymeric material, or the filtering material, depending upon the application in which the module will be used. The occupied portion could be substantially all of the free interior volume, a major part of the interior volume or a minor part of the interior volume. Possibilities range for example from about 20% to substantially all of the free interior volume, and encompass about 25%, about 30%, about 35%, about 40%, about 45%, about 50%, about 55%, about 60%, about 65%, about 70%, about 75%, about 80%, about 85%, about 90%, and about 95%, about 100%, or be within any range whose lower limit is defined by one of those values and whose upper limit is defined by another of those values. The free interior volume means the interior volume within the walls, excluding space taken up by elements such as pillars or other structural members within the interior volume.

It will be appreciated that where in this specification there is a description of a module which incorporates, for example, a porous foamed polymeric material such as the OASIS™ foam, that description also applies to the module with the foamed polymeric material replaced by another water retentive material, or by another filtering material, or of another foamed polymeric material.

There are many uses to which aspects of the invention may be put, as will be discussed by reference to a range of embodiments of the various different aspects of the invention, which are described below with reference to the accompanying drawings in which:

FIG. 18 shows another arrangement of the modules used in a roof construction;

FIG. 19 shows another arrangement of the modules used in, a roof construction;

FIG. 20 shows one embodiment of a pavement system;

FIG. 21 shows another embodiment of a pavement system;

FIG. 22 shows a module with a modified insert;

Figure 3:
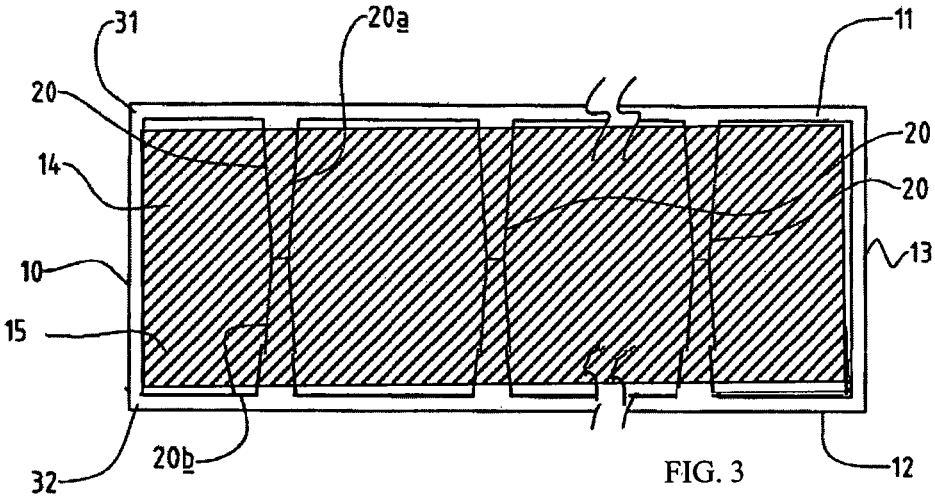
FIG. 3 is a section of FIG. 1, showing an alternative porous element.
Figure 4:
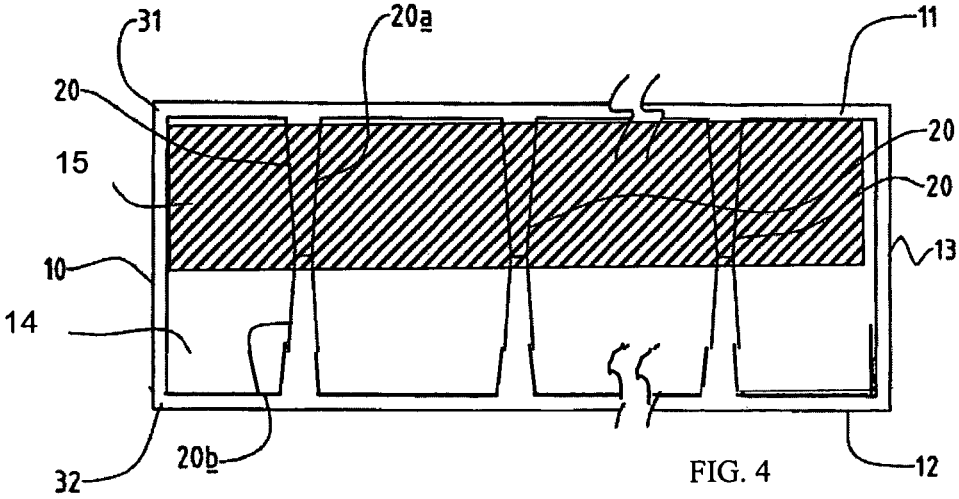
FIG. 4 is a section of FIG. 1, showing a second alternative porous element.

Referring now to FIGS. 1 to 5, a storage module is shown at 10 comprising a top wall 11, a bottom wall 12 and a peripheral wall 13 extending between the upper wall 11 and the bottom wall 12 to provide at least one side wall and in this example four side walls. The top wall 11, bottom wall 12 and peripheral wall 13 define a volume 14. Located within the volume 14 is a porous rectangular block 15. The porous material in this case is a foamed phenol formaldehyde resin, such as that marketed by Smithers-Oasis under the trade mark OASIS™ as discussed earlier. The block 15 is fixed relative to the top wall 11, bottom wall 12 and peripheral wall 13 and in this case occupies the bottom part of the volume 14, extending upwards for approximately half of the height of the volume. In FIG. 3 there is shown an alternative arrangement in which the block 15 occupies substantially all of the volume 14, and in FIG. 4 there is shown an alternative arrangement in which the block 15 occupies the top half of the volume 14.

Figure 1:
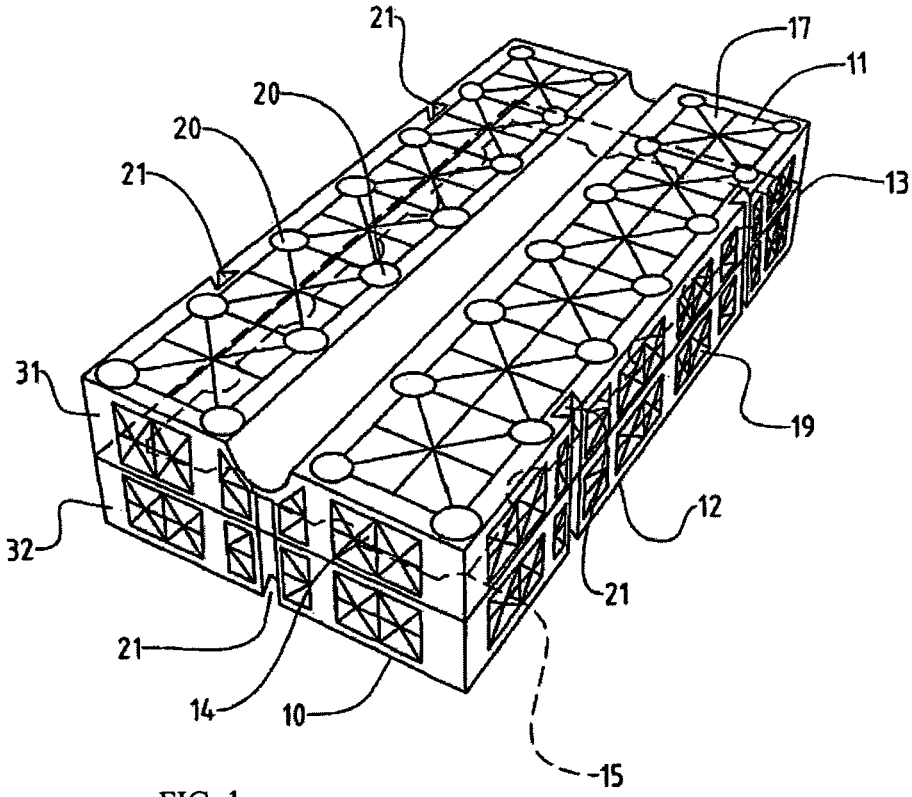
FIG. 1 is a perspective view of a module embodying the present invention.
Figure 2:
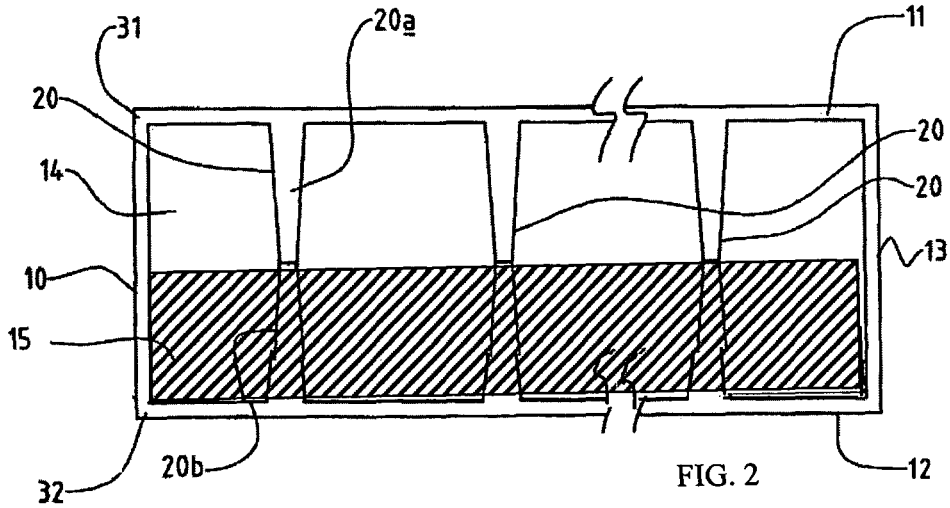
FIG. 2 is a section of FIG. 1.
Figure 6:
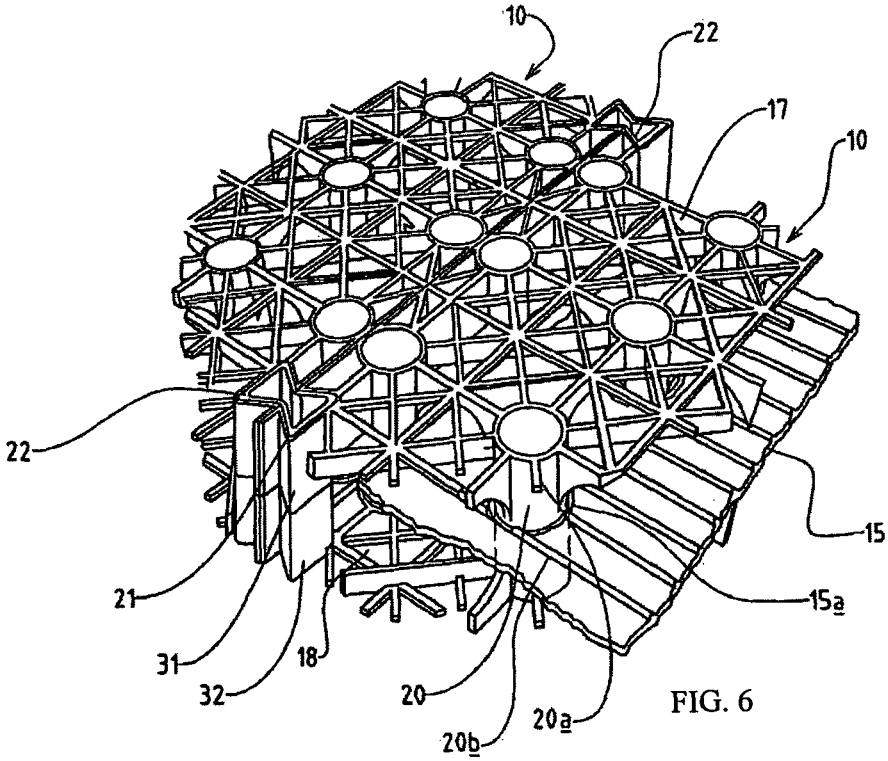
FIG. 6 is a broken away perspective view on a larger scale of part of two of the storage modules of FIG. 1 connected to one another.

As seen in FIGS. 1 and 6, the top wall 11, bottom wall 12 and peripheral wall 13 comprise a plurality of apertures 17, 18, 19 which in this example are generally triangular and defined by a plurality of pillars forming the respective walls. The apertures 17, 18, 19 thus permit fluid to move in and out of the module 10.

Internally, in this example the storage module 10 comprises a plurality of pillars 20 extending between the top wall 11 and the bottom wall 12. In the present example, the pillars are generally cylindrical and hollow and are distributed in a grid arrangement across the length and width of the module 10. The pillars 20 are sufficiently strong to resist crushing of the module 10 and thus enable the module 10 to support a desired vertical or lateral load depending on the application in which the storage module 10 will be used.

To allow a plurality of modules 10 to be rigidly connected together, for example for use as a sub-base layer, the module 10 is provided with a plurality of keyways 21 located in the ends of the sides thereof. In this example, each keyway 21 is a groove of a generally female dovetail shape in plan view for slidably receiving a tie member 22. As best seen in FIG. 6, the tie members 22 are of "bow tie" cross section, comprising a pair of trapezoids joined together along their short parallel sides to be received in the keyways 21 of adjacent modules 10 to hold them together. As will be apparent, the generally rectangular shape of the modules 10 enables a plurality of modules 10 to be connected together to form an extensive, substantially continuous layer modules 10 of any desired area.

Advantageously, each module 10 may be formed in two parts which are connected together to form the module 10, where porous block 15 is introduced into the module prior to connecting the two parts together. With reference to FIGS. 6 and 1, advantageously the module 10 may comprise a top part 31 which defines the top wall and part of the peripheral side wall and a bottom part 32 defining the bottom wall and the lower part of the peripheral side wall. The top part 31 and the bottom part 32 are each provided with a set of half-pillars 20*a*, 20*b* whereby the two sets of half-pillars, 20*a*, 20*b* engage one another to form the pillars 20 extending between the top wall 11 and bottom wall 12. Preferably the top part 31 and bottom part 32 comprise similar plastic moulded components. The module 10 may be formed by inverting one component and placing it on top of the other, and introducing the porous block 15 into the volume prior to joining the two parts. As noted below, in some applications module which are not filled with foam can be used. Where foam is used, it need not be introduced as discussed above, but could be in the form of one or more blocks not shaped to the interior of the module, as loose material, or be injected as foam and cured in-situ.

Figure 5:
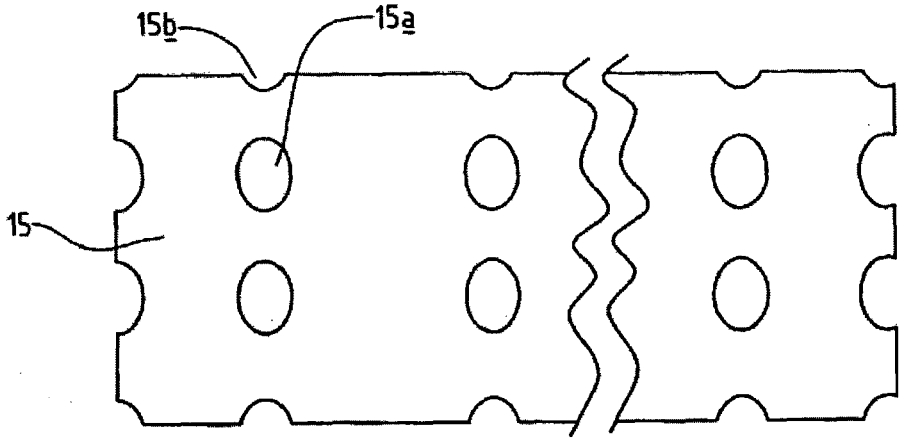
FIG. 5 is a plan view of the porous element of FIGS. 2, 3 and 4.

As seen in FIG. 5, since the module 10 is provided with pillars 20 the porous block 15 is provided with appropriate apertures 15*a* and/or cut outs 15*b* to receive the pillars 20. Such a configuration is advantageous in that the porous block 15 is constrained from substantial lateral movement by virtue of engagement of the pillars 20 in the apertures 15*a*, and is also constrained from vertical movement because the size of the apertures 15*a* is chosen so that there will be a reasonably tight fit with the pillars 2, thus locating the block firmly in the desired position in the module.

Figure 7:
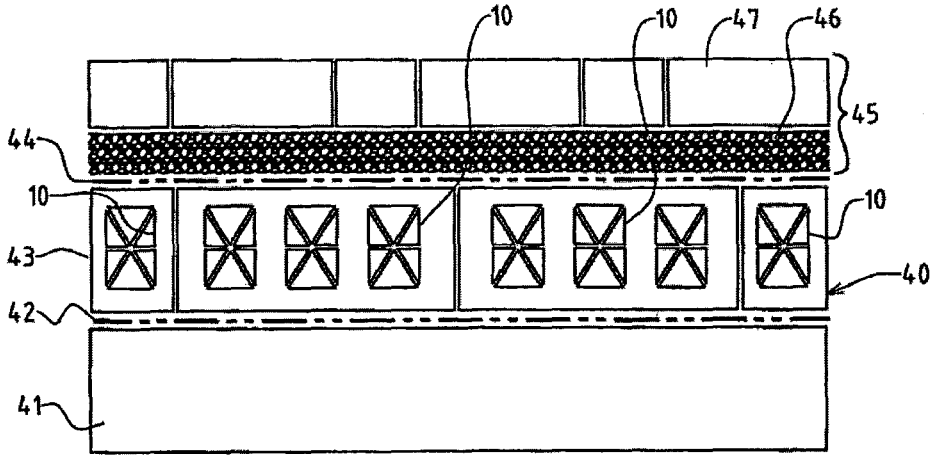
FIG. 7 shows a drainage system incorporating a number of modules in accordance with the invention.

In FIG. 7, a drainage system comprising a plurality of storage modules 10 is shown at 40. The drainage system 40 comprises an appropriate base 41, such as a compacted sand bedding layer. An appropriate layer 42 is laid on the bedding layer 41, which may be impermeable, to resist passage of liquid and particularly water into the bedding layer, or may be permeable to permit water to infiltrate down through the bedding layer. At 43, a layer is shown comprising a plurality of modules 10 connected together as described above. A further, optional geotextile layer 44 is laid on top of the module layer 43, in this case comprising a pervious geotextile to permit water or other liquid to pass into, the module layer 43 but resisting the passage of detritus such as grit or gravel and advantageously absorbing oil. On top of the further optional geotextile layer or geomembrane 44 is an operative layer 45, in this example comprising an upper bedding layer 46 provided with a top layer 47.

This may for example be the surface for a car park, a roadway, a pedestrian area or other construction, using a suitable material such as concrete block paving porous asphalt, open textured macadam or unbound granular material.

The drainage system 40 operates as follows. When rain matter or other liquid falls on the upper surface of the operative layer 45, the water will infiltrate down through the layer 45 and through the further geotextile layer 44 into the module layer 43. Because of the apertures 17, 18, 19 the water will be able to enter the modules 10 and also flow between adjacent storage modules 10. The module layer 43 provides a large volume to receive run-off liquid, thus removing the disadvantages associated with conventional drainage ducts which may backup and overflow, for example in the case of heavy rainfall.

When water enters the module layer 43 it will fill the volume 14 of the storage modules 10 and the porous elements 15 will absorb and retain substantial quantities of water.

Modules in accordance with the invention may be used as above or in other ways similar to those described in WO 02/14608. However, the modules can also be used in many novel ways, as described by way of example only with reference to FIGS. 8 to 40. In these figures, the modules 10 are shown in diagrammatic form only.

Figure 8:
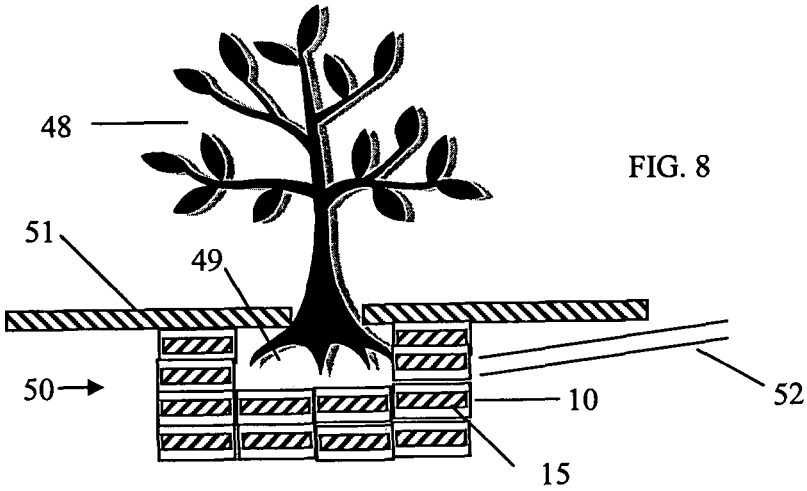
FIG. 8 is a section through a system provided for a tree.
Figure 9:
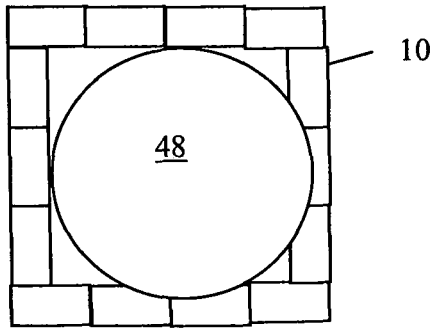
FIG. 9 is a plan view of the system of FIG. 8.

FIGS. 8 and 9 show how the modules 10 can be used around a tree 48 to retain moisture around the root ball 49 and permit aeration. Typically, root balls for trees have to be in relatively deep holes so that the tree will be stable. It is important to allow oxygen to permeate to the roots, and in a rural environment a layer of loose top soil would be used. In an urban environment, the areas around trees may have to bear significant loads, and trees may be surrounded by paving stones or the like, with a relatively small spacing around the tree, restricting the area for water and oxygen to permeate into the earth. By using a sub-base layer of modules 10, in the earth 50 around a tree, and a permeable top layer 51, which can for example be pervious paving, gravel or any other suitable layer, a structurally stable environment is provided, whilst air and water can permeate through to the roots. The porous material 15 retains the water in areas close to the roots of the tree. To assist in providing water to the region, a gulley 52 may be provided, for example, linking the area to a source of water such as a reservoir, stream and so forth.

In the arrangement illustrated, there is a layer of modules 10 underneath the tree root. This could be any number of modules deep, one or more, and could extend radially as far as is required. There is also a vertically extending wall of modules around the tree root, comprising a number of layers of modules arranged in a square. The square could be any number of modules, one or more, wide, and any number high. The layer of modules underneath the tree and the wall of modules around the tree could be used separately or together as shown. Arcuate modules could be used to form a circle, in place of a square configuration around the tree, and in general the modules could be arranged in any configuration around the tree. The preferred cuboid modules could be used with their longest dimension extending horizontally, or placed on end with their long direction extending vertically, and this applies to a number of them embodiments described.

The gulley 52 could be constructed using modules 10, with or without the foam inside, and one or impermeable membranes could be used to define the gulley. In general, if there is sufficient access for water to the region around the tree containing modules 10 with foam blocks inside, or any other region where it is desired to retain moisture, a permeable membrane could be used outside the blocks to assist in water retention. However, the foam blocks are preferably such that water retention is sufficient without the use of a membrane as well.

Figure 10:
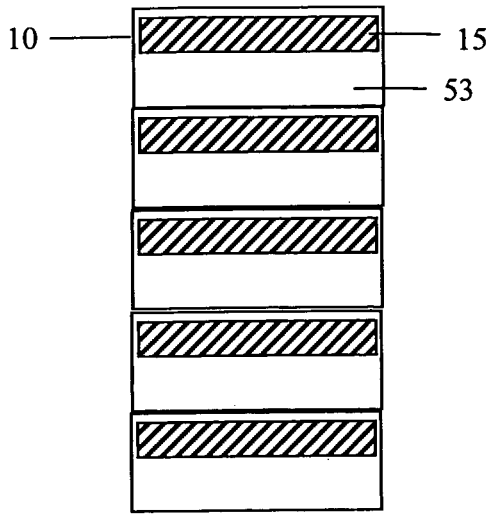
FIG. 10 shows a vertical stack of modules with only one half provided with an insert.

FIG. 10 shows five modules 10 stacked on top of each other, although the principle applies to any number. Each module has a porous block 15, in accordance with the invention, in this case occupying the top half only of each module and extending vertically for about 75 mm. This leaves free space 53 inside the module 10, below the block. In the vertical direction, there are therefore alternating layers 15 of porous material and free space 53 to permit the flow of water.

Figure 11:
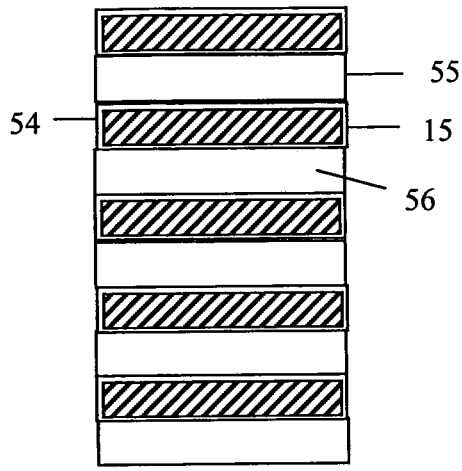
FIG. 11 show a vertical stack of alternating modules which have no insert and which have a full insert.

FIG. 11 shows an alternative arrangement, using modules 54 and 55 of half the depth of module 10. Module 54 contains a porous block 15, but module 55 is empty and has free space 56. In the vertical direction, there are therefore alternating layers 15 of porous material and free space 56 to permit the flow of water.

Figure 12:
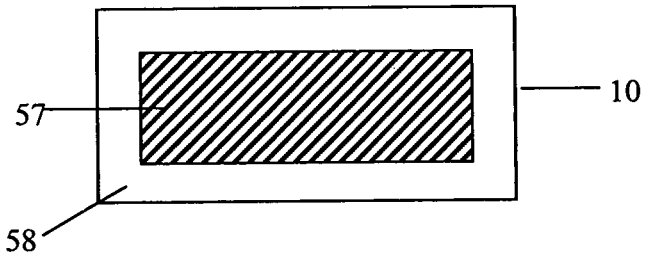
FIG. 12 shows how an insert may be arranged in a module to provide a flow path around the insert.
Figure 13:
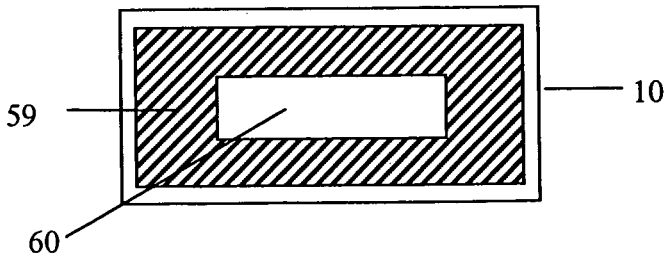
FIG. 13 shows how an insert may be arranged in a module to provide a flow path through the insert.

FIG. 12 shows how a porous foam block 57 may be mounted inside a module 10, in such a way as to provide free space 58 around the outside the block, for the passage of water. FIG. 13 shows how a porous foam block 59 may be positioned inside a module 10, this case the block having an aperture 60 to provide free space for the passage of water. It is preferred that there be free passage for water inside any module 10, either around or through a porous block. Alternative aperture shapes could be provided, and any, desired number of apertures. The arrangement could be such as to promote vertical flow of water, in which case FIGS. 12 and 13 would be plan view, or horizontal flow of water, or both.

Figure 14:
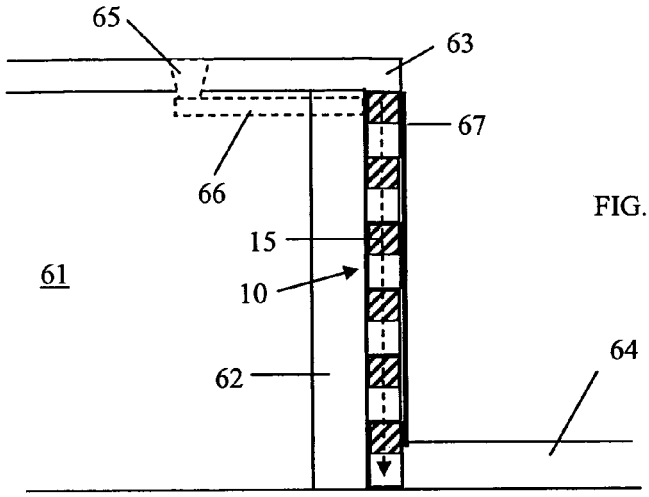
FIG. 14 shows how modules can be used to construct a vertical wall covered in vegetation.

The ability of stacked modules to retain water, particularly if there are alternating layers of foam and free space, make it possible to construct open faced walls, which can be covered with vegetation such as grass, for example. FIG. 14 shows such an arrangement and is a diagrammatic section, with modules 10—containing blocks of foam 15 in their upper halves only, viewed from the side. In an alternative arrangement the foam blocks could occupy the bottom part only of the modules. A bank of earth 61 is provided with a structural retaining wall 62. This is faced by a layer of the modules 10, containing the blocks 15. A top layer 63 of e.g. grass is provided above the earth, retaining wall and blocks. At the bottom of the structure, on the outside, is a layer 64 which can be paving, grass or whatever is desired. A water source 65 is connected to the top module 10 by a conduit 66. Any water from the source, which could just be a trap for rainwater, will flow into the foam block in the top module. It saturates that block and then drops down through the free space below the foam block to the foam block in the module below. This continues down the stack of modules, as indicated by the dashed arrow. Thus moisture is retained in foam blocks from the top to the bottom of the structure. The stack of modules 10 is faced with a sheet of geotextile material 67, in which can be seeded plants, grass, moss and so forth which draw moisture from the foam blocks 15. In an alternative arrangement, the modules 10 could be separated by permeable means such as a geotextile, grid, apertured members and so forth.

Figure 15:
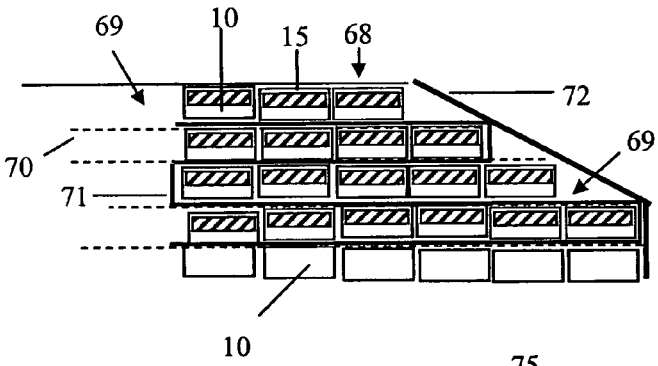
FIG. 15 shows how modules can be used to create a vegetated wall at the edge of a stabilised soil structure.

FIG. 15 shows how modules 10 with foam inserts 15 in their upper halves can be used to provide a vegetated wall 68 at the edge of a stabilised soil structure 69 incorporating grids 70 or geotextile membranes 71 or both. As with a number of other embodiments, the foam blocks could alternatively be in the lower halves of the modules. The bottom layer of modules has no foam inserts, to provide maximum drainage. A seeded geotextile membrane 72 is provided, in a manner similar to the membrane 67 in the preceding embodiment. Such stabilised soil structures can be used as embankments, for noise attenuation along motorways, and so forth.

Figure 16:
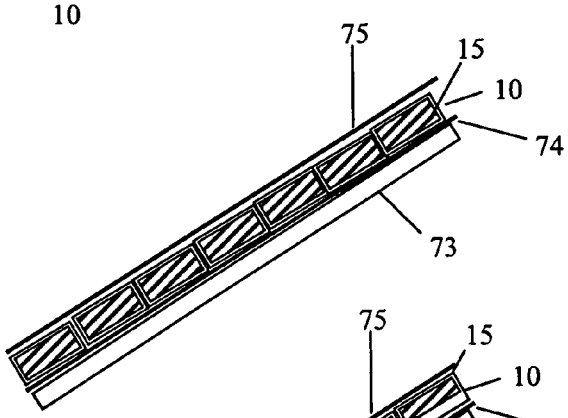
FIG. 16 shows how the modules can be used in a roof construction.
Figure 17:
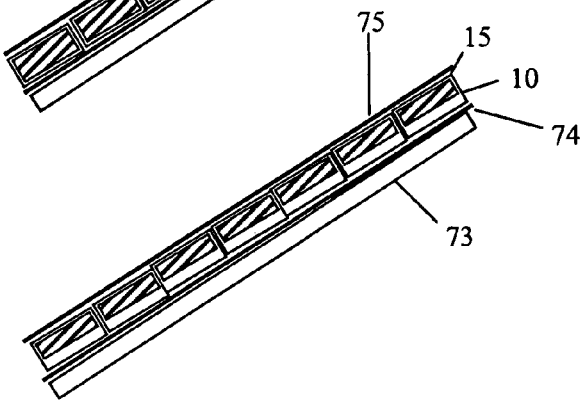
FIG. 17 shows another arrangement of the modules used in a roof construction.

FIG. 16 shows a roof construction incorporating modules 10 which are filled with foam blocks 15 There is an underlayer 73, for example of wood, metal, concrete or any other roof material, an impermeable membrane 74, a layer of the blocks 10, and a top layer 75 of a permeable geotextile which has been seeded with grass, moss or another suitable top finish for the roof. FIG. 17 shows a similar arrangement with the foam block 15 occupying only the top half of the modules 10. In an alternative arrangement, the foam blocks could occupy only the bottom halves of the blocks 15. Arrangements with only half of the modules filled with foam blocks provided improved aeration for vegetation growing as the top finish for the roof. FIG. 18 shows an arrangement in which free space and foam blocks inside the modules 10 arranged perpendicular to the slope direction of the roof.

These embodiments show how the modules 10 with foam inserts 15 can be used to store water on a sloping structure such as a roof. The foam blocks can contain nutrients for the vegetation. By suitably arranging modules which are filled with foam blocks, or only partially provided with foam blocks, or have no foam blocks at all, preferred regions can be defined as flow paths or as regions where water is to be stored.

FIG. 19 shows how using a combination of foam-filled modules and partially foam-filled modules 10 can be used to create voids 76. The voids could be passively or actively ventilated. The arrangement provides enhanced evaporation of moisture via capillary action. The top layer 75 could be a seeded membrane as discussed above, or could be a hard layer such as shingles or tiles.

FIG. 20 shows a paving arrangement using partially foam-filled modules 10. In this arrangement there is a pervious pavement 77, for example made from paving blocks with gaps between them so that water can pass through to the layers underneath, one being formed from modules 10. The first flush of water through the pavement after rainfall will normally contain the maximum amount of pollutants, and this is absorbed by the foam blocks 15. The next flow will be channelled through the free spaces 78 to a desired point. FIG. 21 shows a modification in which the pavement 79 is impervious, and water drains to a gully 80 from where a conduit 81 channels the water to the layer of modules 10. FIG. 22 shows a modified module 10 for use in arrangements intended to handle the first flush of water draining from the surface. In the case the foam insert 15 has one or more pockets or recesses 82. Alternatively, another type of absorbent material could be recessed in the foam 15. The purpose of this arrangement is to provide regions where dense non-aqueous phase liquids can be trapped more permanently, for example for treatment by microorganisms within the foam.

Figure 23:
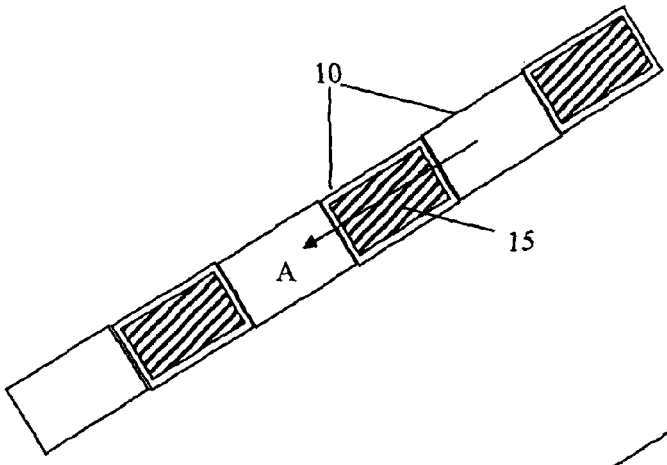
FIG. 23 shows a filtering arrangement.
Figure 24:
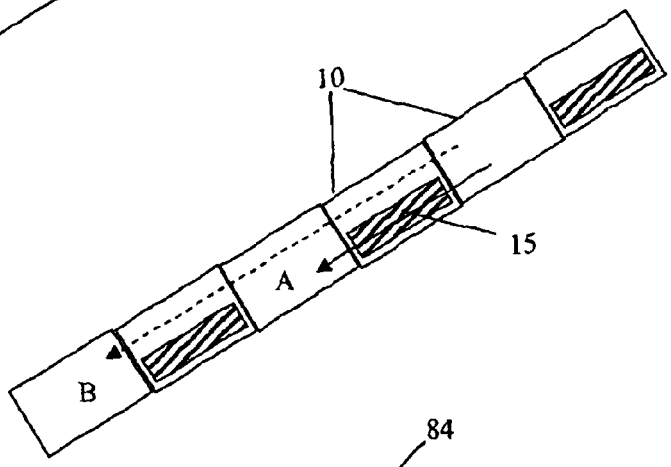
FIG. 24 shows an alternative filtering arrangement.

FIG. 23 shows how a series of modules could be arranged to provide a series of spaced filters, with modules 10 without foam alternating with modules with foam 15, so that liquid will be filtered as it flows in the direction of arrow A. FIG. 24 shows a similar arrangement, but in which the modules with foam are only partly filled, so that in addition to the filter route indicated by the arrow A, there is a bypass non-filtering route indicated by arrow B. In an alternative arrangement, a system such as that in FIG. 23 could include a layer of empty modules 10 to provide the bypass route.

It will be appreciated that in an arrangement such as this, and in other filtering arrangements, the insert in the modules 10 need not be of a water retentive material, but could just be provided to act as a filter. Similarly, modules that are used to define channels and direct fluid flow, could use inserts that are not porous at all. Thus, a set of modules 10 could be provided which are empty, filled with water retentive porous material, part filled with water retentive porous material, filled with porous filtering material, part filled with porous filtering material, filled with impermeable material or part filled with impermeable material. Depending on the application concerned the appropriate number and type of modules would be selected. Permeable and/or impermeable membranes and geotextile materials may also be used as desired.

Figure 25:
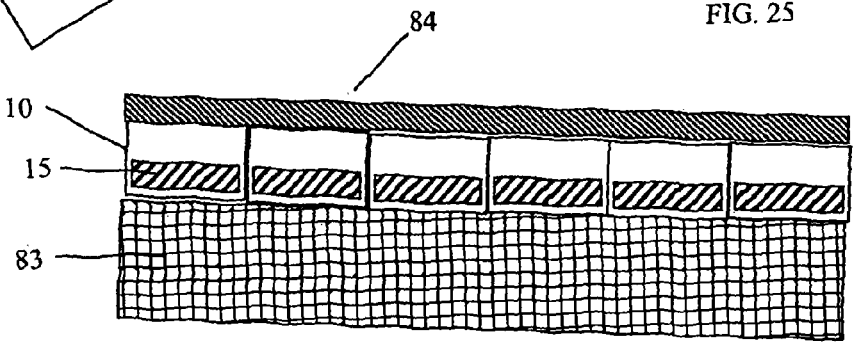
FIG. 25 shows an arrangement for keeping a layer of clay moist.

FIG. 25 shows an arrangement in which modules 10 which are provided with half height blocks of foam 15, are used to retain moisture above a layer of clay 83, to keep the clay moist and stop it cracking. The clay could for example be used to cap landfill. In this arrangement there is a free flow path to provide drainage, but alternatively modules filled with foam could be used. There is an upper layer 84 of earth, grass or the like above the modules.

Figure 26:
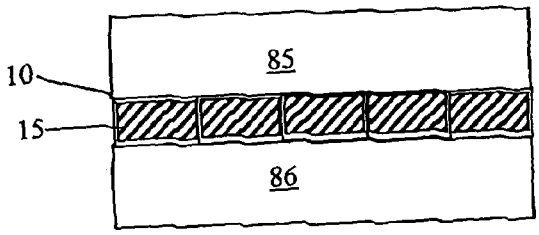
FIG. 26 shows how modules can be used for filtering.

FIG. 26 shows how in general modules 10 filled with foam 15 can act as a separation filter between two areas 85 and 86. For example, one could be an area containing polluted water, and the other an area with relatively clean water. The modules could be used as a filter in water treatment, with the speed of release depending on the type of foam used. Using the water retentive foam discussed above, the filter would provide a slow release of water. The modules 10 could be only part filled with foam, with the foam facing the contaminated side and the free space facing the clean side. In this arrangement the modules can form a pathway for cleaning ground water for example. This arrangement could be vertical or horizontal within the ground or above the ground.

Figure 27:
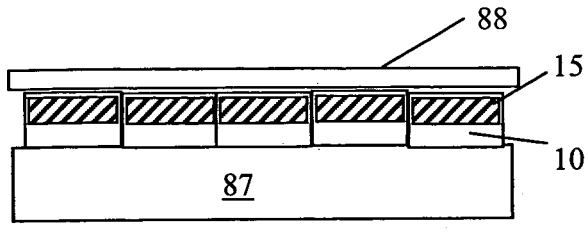
FIG. 27 shows modules used in the construction of a sports pitch.
Figure 28:
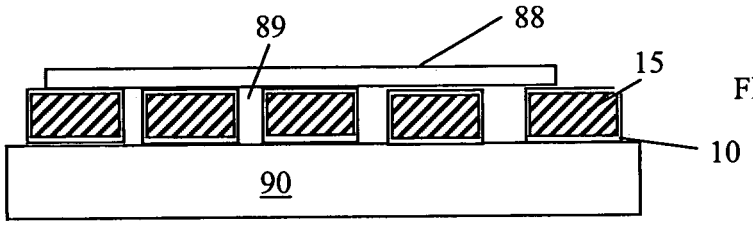
FIG. 28 shows modules used in an alternative arrangement for the construction of a sports pitch.

FIG. 27 shows how a sports pitch could be constructed using modules 10 which are provided with half height blocks of foam 15. The modules are placed on a base 87 and turf 88 is laid above the modules. The foam blocks retain water and can also be impregnated with feed for the grass. The intention is to keep the grass in good condition but to prevent it being waterlogged. The free space in the modules 10 provides drainage. FIG. 28 shows a variation of this arrangement, in which the foam blocks 15 inside the modules 10 are full size. In this case, the modules are separated by spaces 89, so as to provide a drainage path to an underlying drainage layer 90 of gravel or the like. In both cases, there is a layer for holding water, and a layer for drainage. In either arrangement, there could be a complete blanket of modules under the pitch, or modules could be provided only in spaced apart areas, for example in stripes, thus reducing cost. The modules could incorporate heating units, conduits for heating fluids such as hot water pipes, and any other heating system components to provide heating for the pitch in cold weather, and could be used for transporting warm air beneath the pitch.

Figure 29:
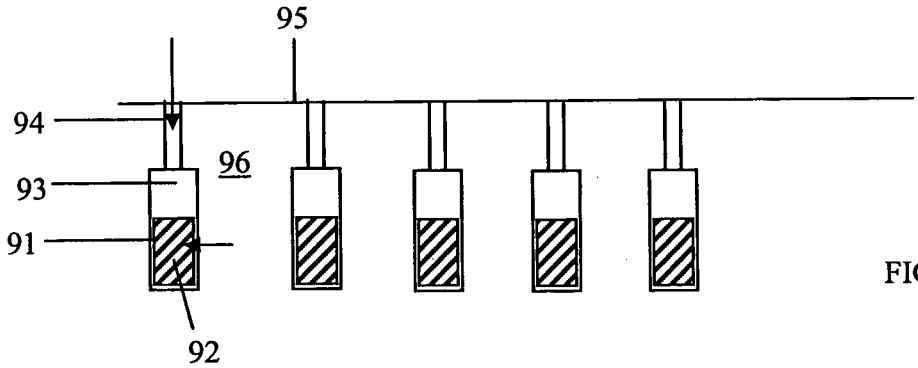
FIG. 29 shows modules used in an alternative arrangement for the construction of a sports pitch.

FIG. 29 shows an alternative arrangement for a sports pitch, in which modules 91 have their lower parts filled with the porous foam 92, leaving voids 93 at the top. Narrow slots 94 filled with, for example gravel or sand are provided to connect the voids to the playing surface 95. The foam blocks receive water that has passed into the voids, and also water from the surrounding soil 96. In the event of rain fall, water passes quickly into the voids and can be channelled to drains. Excess water is absorbed by the porous foam, thus relieving the load on the drainage system, and can then be released over time to irrigate the pitch.

Figure 30:
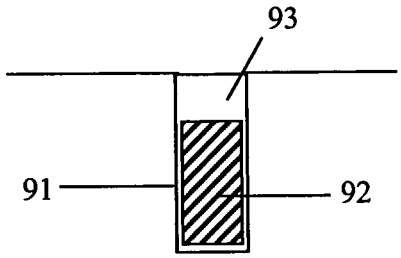
FIG. 30 shows a module used as a soakaway for a trench.

It will be appreciated that modules 91 as described above could be used in other situations where it is desired to have controlled drainage. For example, FIG. 30 shows such a module used as a soakaway for a trench or a "French drain".

Figure 31:
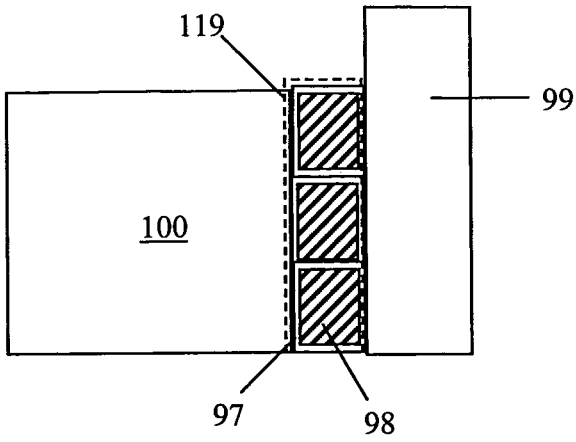
FIG. 31 shows modules used to move water vertically behind a wall.

FIG. 31 is an example of how vertically stacked modules 97 filled with foam blocks 98 can be used to move water upwards by capillary action. The foam blocks have a height which is less than the maximum height to which water can move by capillary action against the effects of gravity. This can be achieved by means of sectioning the foam using membranes to create semi-isolated foam cells. Typically this would be about 150 mm, as discussed earlier. Typically, the stack of modules would be surrounded with a water absorbent geotextile 119, which will act as a wick. Thus water at the bottom can be moved to the top by capillary action, and can be diverted to any drainage route desired. In this case, the modules are provided behind a wall 99, such as a flood defence wall, between the wall and another region 100.

Figure 32:
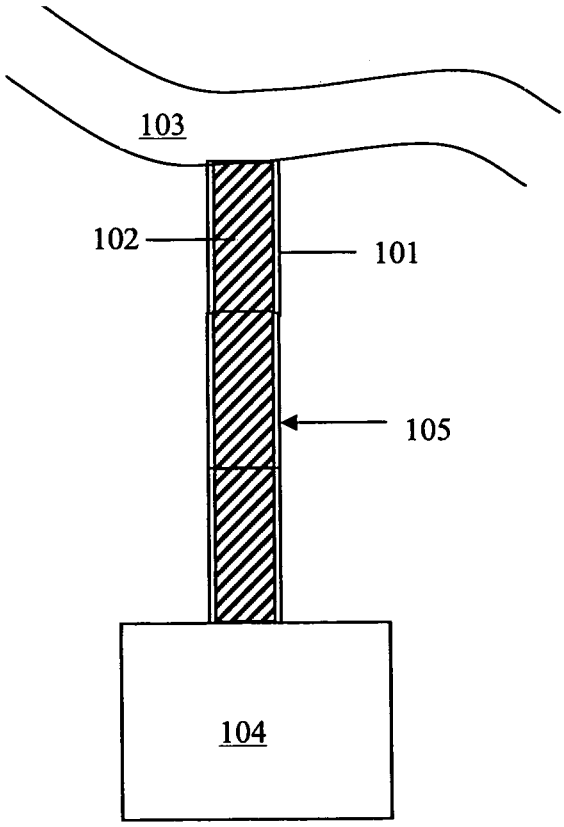
FIG. 32 shows a system for moving water from a stream.

FIG. 32 is an example of how horizontally arranged modules 101 containing foam 102 can transfer water horizontally, for example for irrigation. In this case, the modules use capillary action to act as wicks to move water from a stream 103 to an area 104 to be irrigated, along an irrigation route 105 defined by the modules. This could, for example be an arrangement of modules in the region of a tree, as shown in FIGS. 8 and 9. At the stream end, a number of the modules 101 could be stacked vertically, so as to be capable of absorbing water over a range of stream heights. Capillary action could be used to move water from a variety of heights to a common irrigation route 105.

Figure 33:
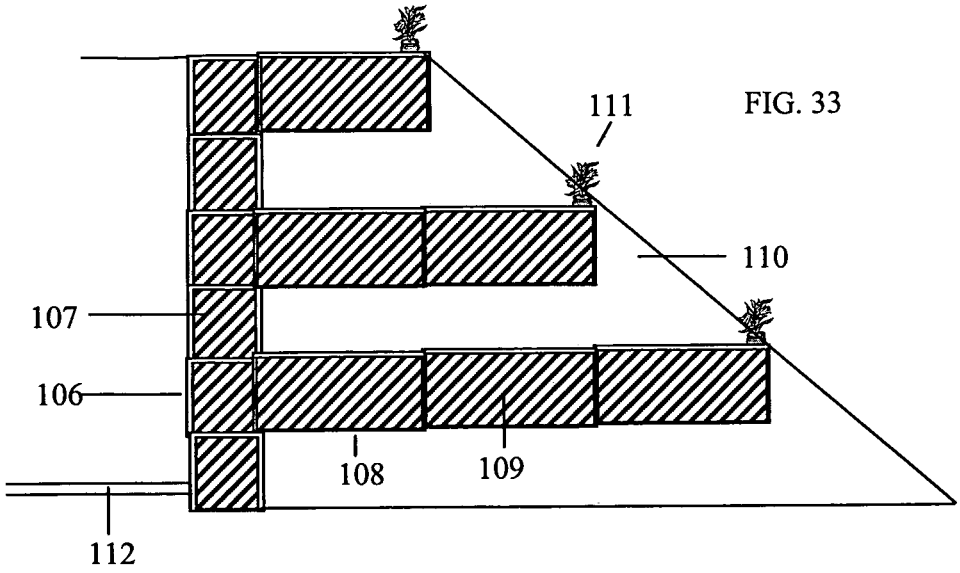
FIG. 33 shows a horizontal and vertical capillary irrigation system.

FIG. 33 shows how capillary action can used to provide both vertical and horizontal movement. Modules 106 containing foam 107 are stacked vertically and connect to rows horizontally arranged modules 108 containing foam 109. Typically, the stack of modules would be surrounded with a water absorbent geotextile, which will act as a wick. In this way water can be brought to the face of an embankment 110, for example, where plants 111 can grow. Water could be supplied to the modules 106 by any of the ways mentioned earlier of for example by a pumped or gravity water feed as indicated at 112.

Figure 34:
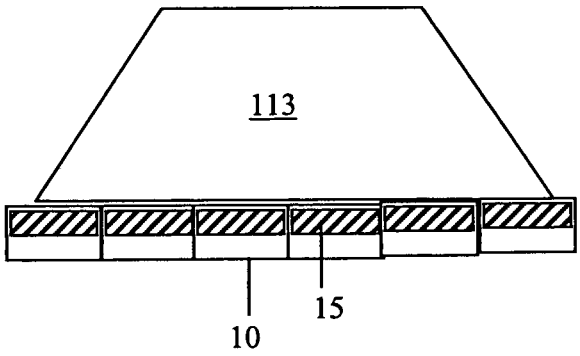
FIG. 34 shows modules used under a bio pile.

FIG. 34 shows how a layer of modules 10 partially filled with foam 15 can be positioned under a bio pile such as a compost heap 113. The modules support the heap 113, whilst allowing aeration of the lower layers in the heap, and removal of liquid leaching down from the heap.

The modules described above provide substantial structural support, and the inserts within them can provide many different functions. Foamed polymeric inserts can be chosen depending on the desired function, and need not be water retentive as discussed earlier. Modules incorporating inserts can be used to provide partition walls, fire suppressant barriers and so forth. Using impervious foams, the entire module can be made buoyant and can be used, for example, to construct a pontoon. The preferred method of joining adjacent modules provides a simple but secure join.

Treatment of fluids in systems utilising the modules with foam inserts could include the use of aeration/diffusion agents, for example using fine bubbles, methane stripping, or oxygen injection; gas treatments such as oxidation; or heavy metal removal.

In preferred embodiments of all aspects of the invention, the structural module has rigid top and bottom walls and rigid supporting elements, such as pillars or a sidewall, so that it can resist collapse under the loads to be encountered, which could for example include the weight of pedestrians, animals or vehicles passing over the module. A preferred module has a short term vertical compressive strength of at least about 500 kN/m$^2$, more preferably at least about 650 kN/m$^2$, and more preferably at least about 700 kN/m$^2$. The short term vertical deflection is preferably less than about 2 mm/126 kN/m$^2$, and more preferably less than about 1.5 mm/126 kN/m$^2$, in a preferred arrangement being about 1 mm/126 kN/m$^2$. A preferred module is manufactured in a strong, rigid plastics material such as polypropylene copolymer.

Preferably, the percentage of the volume of the module that is void space, ignoring the presence of a foam insert or the like, is at least about 80%, at least about 85%, or at least about 90%. In a preferred embodiment the void space is about 95%. For a module with top and bottom walls and a side wall enclosing a volume within the module, the percentage of surface area that is apertured is at least about 40%, at least about 45%, or at least about 50%. In a preferred embodiment the percentage of surface area that is apertured is about 52%.

One suitable module has the following parameters.

Weight 3.00 kg
Dimensions
Length 708 mm
Width 354 mm
Height 150 mm
Short Term Compressive Strength
Vertical 715 kN/m$^2$
Lateral 156 kN/m$^2$
Short Term Deflection
Vertical 1 mm per 126 k N/m$^2$
Lateral 1 mm per 15 kN/m2
Ultimate tensile strength of a single joint 42.4 kN/m$^2$
Tensile strength of a single joint at 1% secant modulus 18.8 kN/m$^2$
Bending resistance of module 0.71 kNm
Bending resistance of single joint 0.16 kNm
Volumetric Void Ratio 95%
Average effective perforated surface area 52%

In preferred arrangements, modules can be connected together to form a layer by ties, such as tie members 22 discussed earlier. Modules may be connected vertically by tubular shear connectors which can fit into the open ends of the support pillars in the arrangement described earlier.

Figure 35:
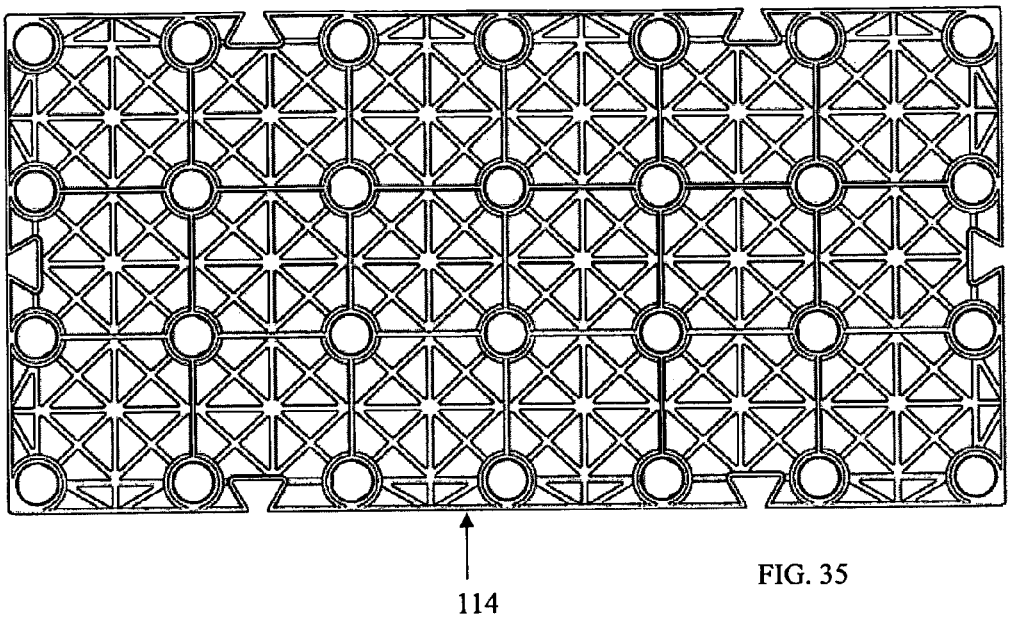
FIG. 35 is a plan view of a preferred module for use in aspects of the invention.
Figure 36:
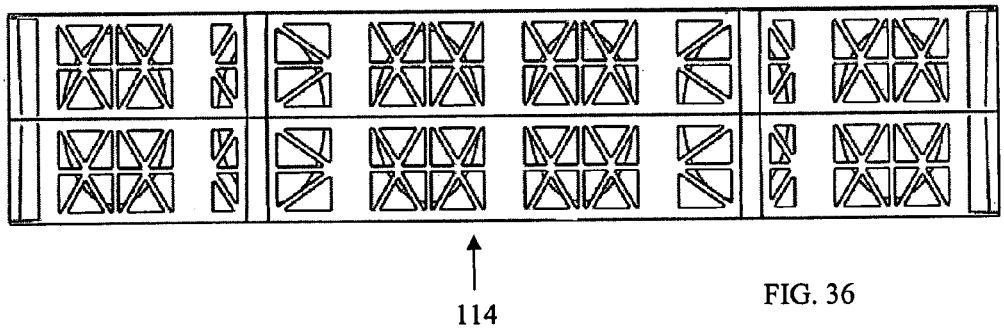
FIG. 36 is a front elevation of the module.
Figure 37:
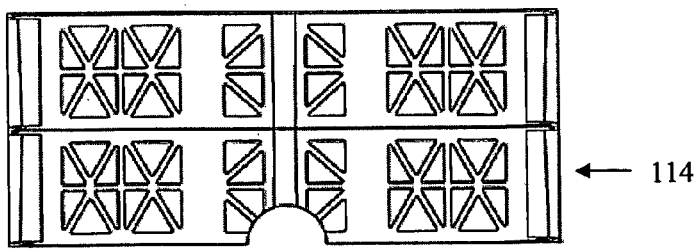
FIG. 37 is a side elevation of the module.
Figure 38:
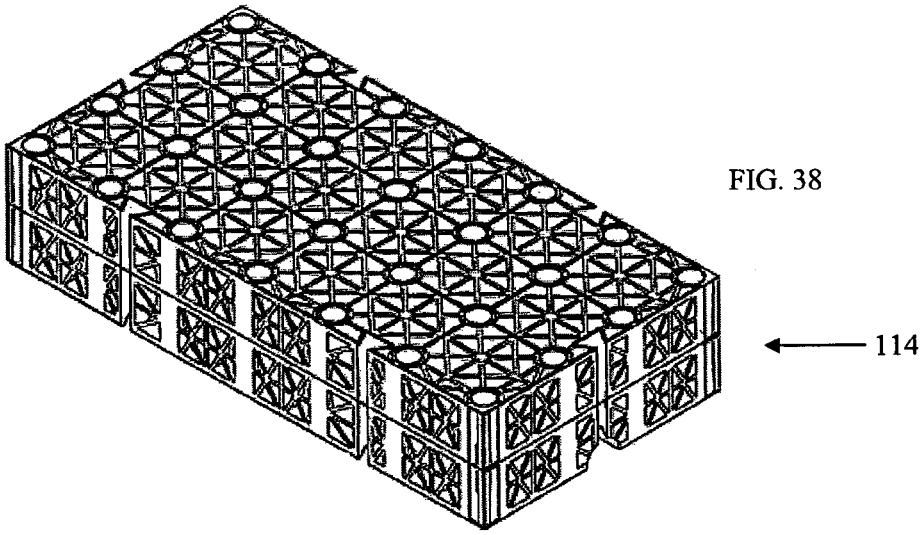
FIG. 38 is a perspective view of the module.

FIG. 35 is a plan view of a cuboid module 114 for use in aspects of the invention, having the parameters set out above. FIG. 36 is a front elevation of the module, FIG. 37 is a side elevation of the module, and FIG. 38 is a perspective view of the module. As with the module described with reference to FIGS. 1 to 6, this module has been moulded in two halves which are then joined together.

Figure 39:
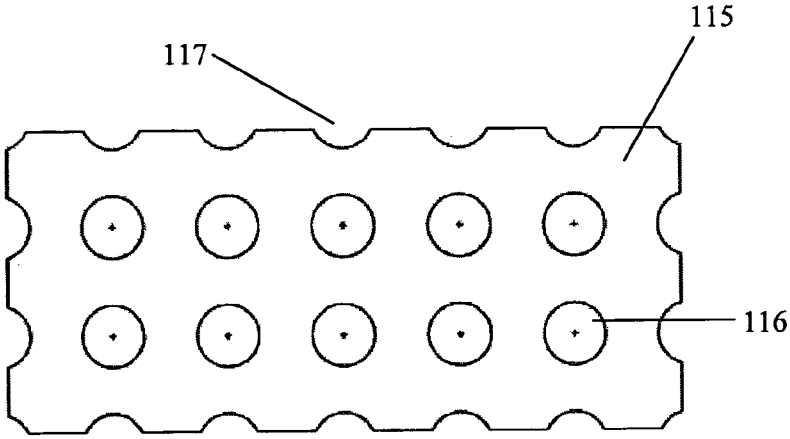
FIG. 39 is a plan view of a porous foam insert to be positioned in the module.
Figure 40:
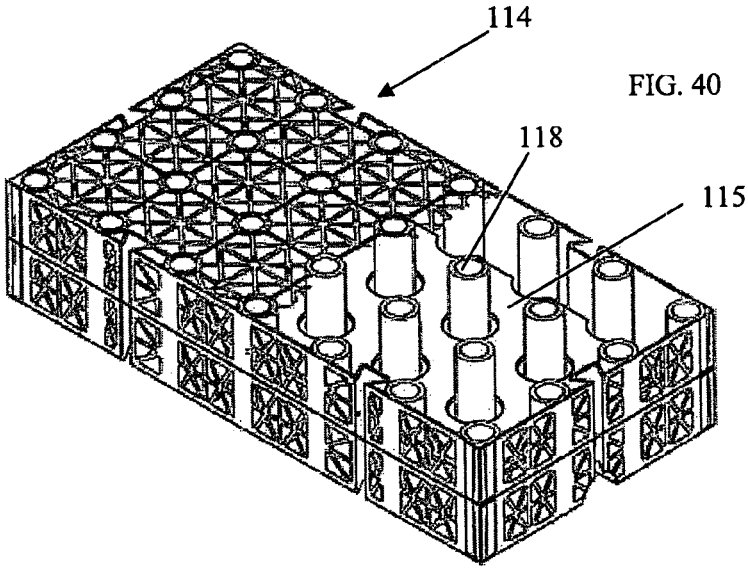
FIG. 40 is a perspective view of the module, partly cut away, showing the insert in place.

FIG. 39 is a plan view of a porous, water retentive, foamed polymeric insert 115 of OASIS (TM) foam to be used within the module 114, this having a thickness of about 75 mm so that it will occupy about one half only of the internal volume of the module. The interior of the module is provided with columns and the insert has apertures 116 and cut-outs 117 to accommodate these. FIG. 40 shows the module partly cut away, showing how the insert 115 has been positioned in the lower half of the module, with the apertures 116 and cut-outs 117 accommodating the supporting columns 118 within the module, in a manner equivalent to that discussed with reference to the module of FIGS. 1 to 6.

The invention claimed is:

1. A structure for drainage and water-retention a plurality of structural modules arranged adjacent each other, each module comprising a load bearing base unit having a peripheral wall, a top wall and a bottom wall spaced therefrom by at least one supporting element so as to define a volume between the top and bottom walls, the base unit being provided with apertures through the peripheral wall and the top wall to permit the flow of liquid into and out of the volume, and wherein at least a first plurality of the modules each contains a porous foamed polymeric material which occupies a substantial portion of the volume within the base unit and absorbs and retains substantial quantities of water that pass into the enclosed volume through the apertures; and further comprising a second plurality of the structural modules in which the volume is free space so as to permit the free passage of substantial quantities of water that pass into the enclosed volume through the apertures; wherein the structural modules of the first plurality and the structural modules of the second plurality are arranged adjacent each other in alternating fashion so as to provide alternating portions of polymeric material and free space.

2. The structure of claim 1, including structural modules of the first plurality and structural modules of the second plurality which are arranged vertically adjacent each other in alternating fashion so as to provide vertically alternating volumes of polymeric material and free space.

3. The structure of claim 1, wherein the polymeric material occupies substantially the entire height of the space between the top wall and the bottom wall of the base units of said first plurality of the modules.

4. A structure for drainage and water-retention a plurality of structural modules arranged adjacent each other, each module comprising a load bearing base unit having a peripheral wall, a top wall and a bottom wall spaced therefrom by at least one supporting element so as to define a volume between the top and bottom walls, the base unit being provided with apertures through the peripheral wall, the top wall and the bottom wall to permit the flow of liquid into and out of the volume; wherein each base unit contains a first horizontally extending layer of substantial thickness of a porous foamed polymeric material which occupies at least 25% of the volume within the base unit and absorbs and retains substantial quantities of water that pass into the volume through the apertures; and each base unit also contains a second horizontally extending layer of free space of substantial thickness which is vertically displaced from the first horizontally extending layer; the modules being arranged adjacent each other vertically so as to provide vertically alternating portions of polymeric material and free space.

5. The structure of claim 4, wherein the layer of polymeric material occupies one half of the available thickness of the volume between the top and bottom walls of the base unit.

6. The structure of claim 4, wherein the layer of polymeric material commences from adjacent the top wall of the base unit.

7. The structure of claim 4, wherein the layer of polymeric material commences from adjacent the bottom wall of the base unit.

8. The structure of claim 4, wherein the thickness of the layer of polymeric material is approximately equal to the maximum vertical distance to which water can be absorbed by the polymeric material by capillary action.

9. The structure of claim 4, wherein the thickness of the layer of polymeric material does not substantially exceed the maximum vertical distance to which water can be absorbed by the polymeric material by capillary action.

10. A method for providing water to earth beneath a surface layer comprising: providing a combined drainage and water retention sub-base layer below the surface layer, the sub-base layer comprising an array of adjacent structural modules, each module comprising a peripheral wall, a top wall and a bottom wall spaced from the top wall by at least one supporting element so as to define an enclosed volume between the top and bottom walls, there being a top array of apertures in the top wall of each module and a peripheral array of apertures in the peripheral wall of each module, wherein at least a first plurality of the modules are occupied by a first horizontally extending layer of a porous foamed polymeric material, and a second horizontally extending layer of free space of substantial thickness which is vertically displaced from the first horizontally extending layer;

the method further comprising permitting a flow of rain water from the surface layer into each enclosed volume, permitting said rain water to flow from each enclosed volume into the enclosed volumes of adjacent modules to provide drainage; absorbing and retaining in the porous foamed polymeric material substantial quantities of said rain, and subsequently releasing the retained rain water to the earth.

11. The method of claim 10, wherein there is further provided a bottom array of apertures in the bottom wall of each module.

* * * * *